US006067064A

United States Patent [19]

Furuhashi et al.

[11] Patent Number: 6,067,064

[45] **Date of Patent: *May 23, 2000**

[54] LIQUID CRYSTAL DRIVING CIRCUIT AND LIQUID CRYSTAL DISPLAY SYSTEM USING THE SAME

[75] Inventors: Tsutomu Furuhashi, Yokohama; Hiroyuki Nitta, Fujisawa; Naruhiko Kasai; Yoshihisa Ooishi, both of Yokohama; Hiroshi Kurihara, Mobara; Takeshi Maeda, Yokosuka; Atsuhiko Higa, Yokohama, all of Japan

[73] Assignee: Hitachi, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/773,227

[22] Filed: Dec. 23, 1996

[30] Foreign Application Priority Data

Dec. 21, 1995 [JP] Japan ..... 7-333022

[51] Int. Cl.[7] ..... G09G 3/36

[52] U.S. Cl. ..... 345/89; 345/3; 345/100

[58] Field of Search ..... 345/3, 50, 51, 345/98–100, 121, 123, 125, 89, 103

[56] References Cited

U.S. PATENT DOCUMENTS 5,357,290 10/1994 Horibe ..... 345/100
5,396,258 3/1995 Zenda ..... 345/3
5,673,061 9/1997 Okada et al. .
5,699,076 12/1997 Tomiyasu ..... 345/103

FOREIGN PATENT DOCUMENTS 0624862 11/1994 European Pat. Off. .
0655726 5/1995 European Pat. Off. .

OTHER PUBLICATIONS

"HD66215T (Common Driver for a Dot Matrix Liquid Crystal Graphic Display with 100–Channel Outputs)", *Hitachi LCD Controller/Driver LSI Data Book*, Mar. 1994, pp. 622–634 (Japanese edition), pp. 751–771 (English edition).

*Primary Examiner*—Jeffery Brier
*Attorney, Agent, or Firm*—Antonelli, Terry, Stout & Kraus, LLP

[57] ABSTRACT

A liquid crystal display system is provided with a driving circuit which corrects the display position in a vertical direction to obtain an excellent display area even when the total vertical line number is short. According to the driving circuit, by switching the output alternating signal GM input to a scan driver 701-1 in a scan driving circuit 104, a selection voltage Vgon is reflected to all the output terminals of the scan driver 701-1 to switch plural lines at the same time and perform a write-in operation. In a scan driver 701-2 and subsequent scan drivers in the scan driving circuit 104, an FLM signal is input to successively reflect the selection voltage Vgon to the output terminals thereof and successively select the line, thereby performing a write-in operation.

5 Claims, 13 Drawing Sheets

LIQUID CRYSTAL DRIVING CIRCUIT AND LIQUID CRYSTAL DISPLAY SYSTEM USING THE SAME

BACKGROUND OF THE INVENTION

1. Field of the Invention

The present invention relates to a driving circuit for a liquid crystal display which corrects the display position in a vertical direction to obtain an excellent display area.

2. Description of Related Art

A driving system for a conventional liquid crystal display will be hereunder described with reference to FIGS. 2 to 4. FIG. 2 is a block diagram of a conventional TFT (Thin-Film-Transistor) liquid crystal display, FIG. 3 is a diagram showing a conventional scan driving circuit, and FIG. 4 is an operation waveform diagram of the conventional scan driving circuit.

In the block diagram showing the conventional liquid crystal display of FIG. 2, reference numeral 101 represents a signal bus for transmitting display data and a synchronous signal which are supplied from a system (not shown), reference numeral 201 represents a liquid crystal controller, reference numeral 202 represents a signal driving circuit, reference numeral 203 represents a scan driving circuit, reference numeral 204 represents a power supply for supplying various voltages, and reference numeral 205 represents a TFT liquid crystal panel.

With respect to the signals output from the liquid crystal controller 201, reference numeral 206 represents a signal bus containing the display data and the synchronous signal to be transmitted to the signal driving circuit 202, reference numeral 207 represents an FLM (First Line Marker signal), reference numeral 208 represents a CL3 clock serving as an operating clock of the scan driving circuit 203, and reference numeral 209 represents a liquid crystal alternating signal M to be supplied to the power supply 204.

Reference numeral 210 represents a drain bus for transmitting a gray-scale voltage generated by the signal driving circuit 202 to the TFT liquid crystal panel 205. Reference numeral 211 represents a gate bus for setting each line of the TFT liquid crystal panel 205 to one of a selection status and a non-selection status on the basis of the scan driving circuit 203. With respect to the voltages generated by the power supply 204, reference numeral 212 represents a Vgon voltage which has a selection voltage level and is one voltage to be supplied to the scan driving circuit 203, reference numeral 213 represents a Vgoff voltage which has a non-selection voltage level and is another voltage to be supplied to the scan driving circuit 203, reference numeral 214 represents a common electrode voltage line for transmitting a common electrode voltage to the liquid crystal panel, and reference numeral 215 represents a gray-scale voltage to be supplied to the signal driving circuit 202.

In the TFT liquid crystal panel 205, the drain bus 210 and the gate bus 211 are arranged to cross each other in a matrix form, and a crossing portion serving as a pixel comprises a TFT 216 functioning as a switching element and a liquid crystal element 217. The gate electrode of the TFT 216 is connected to the gate bus 211 and the drain electrode of the TFT 216 is connected to the drain bus 210. Therefore, a source electrode 218 of the TFT 216 serves as one electrode of the liquid crystal element 217. A common electrode 219 serves as the other electrode of the liquid crystal element 217, and it is connected to the common electrode line 214.

FIG. 3 shows the detailed construction of the conventional scan driving circuit 203. As shown in FIG. 3, reference numerals 301-1 to 301-8 represent scan drivers, and the scan driving circuit is constructed by the eight scan drivers which can be HD66215 (Hitachi LCD controller/driver LSI data book: issued by Semiconductor Enterprise Department on March, 1994, p622–634). The conventional scan driving circuit is described on the assumption that the vertical resolution of the TFT liquid crystal panel 205 is equal to 768 lines. The scan driver HD66215 has 100 output terminals, and G701 to G768 are used for the scan driver 301-8.

In the scan driver 301-1, an FLM (First Line Marker) (207) signal is connected to the input enable signal terminal (DIO1). The input enable signal terminal (DIO1) of the scan driver 301-2 is connected to the output enable signal terminal (DIO4) of the scan driver 301-1 at the front stage. Likewise, in the scan driver 301-3 and the subsequent scan drivers 301, the input enable signal terminal (DIO1) is cascaded to the output enable signal terminal (DIO4) of the scan driver 301 at the front stage.

In all the scan drivers 301, the clock (CL) terminal is connected to the CL3 (208), the power supply terminals V1, V6 are connected to the selection voltage level Vgon, and the power supply terminals V5, VEE are connected to the non-selection voltage level Vgoff. All the alternating terminals (M) for realizing the alternation of the liquid crystal are set to a "high" level.

In the operating waveform diagram of the conventional scan driving circuit of FIG. 4, FLM represents the operating waveform of the first line marker signal 207, CL3 represents the operating waveform of the operating clock 208, EO1 represents the signal of the output enable signal terminal (DIO4) which is output from the scan driver 301-1, and Vg1 to Vg768 represent the operating waveform of the gate bus 211.

The detailed operation of the conventional liquid crystal display will be described with reference to FIG. 2.

The liquid crystal controller 201 converts the display data and the synchronous signal transmitted from the signal bus 101 to display data and a liquid crystal driving signal which are suitable for driving the TFT liquid crystal display. The display data and the liquid crystal driving signal which are to be supplied to the signal driving circuit 202 are transmitted through the signal bus 206, the liquid crystal driving signals to be supplied to the scan driving circuit 203 are transmitted through FLM:207 and CL3:208, and the signal to be supplied to the power supply 204 is transmitted through the alternating terminal M:209.

In the signal driving circuit 202, the display data which are transmitted through the signal bus 206 are successively taken in, and when the taking-in operation of the display data of one horizontal line is completed, the display data are converted to a gray-scale voltage corresponding to the display data of one horizontal data, and then output from the drain bus 210. This operation is repetitively performed line by line by the signal driving circuit 202.

In synchronism with the output operation of the gray-scale voltage through the drain bus 210 to the liquid crystal panel 205 by the signal driving circuit 202, the selection voltage is successively applied via the gate bus 211 in the scan driving circuit 203. The detailed operation of the scan driving circuit 203 will be described later. When the selection voltage (Vgon) is applied via the gate bus 211, the TFT 216 in the TFT liquid crystal panel 205 is set to a selection status, and the gray-scale voltage transmitted through the drain bus 210 is applied to the liquid crystal 217. The twisted angle of the liquid crystal is varied by an effective voltage applied to the liquid crystal 217, whereby the induced ratio of light is controlled to perform a gray-scale display.

Further, when the non-selection voltage (Vgoff) is applied via the gate bus 211, the TFT 216 in the TFT liquid crystal panel 205 is set to a non-selection status so that the voltage applied to the liquid crystal 217 is kept. By repeating this operation during one frame period, all the TFTs 216 are allowed to be selected. The scan driving circuit 203 as described above will be described in detail with reference to FIGS. 3 and 4.

The scan driving circuit 203 comprises the eight scan drivers 301-1 to 301-8 as shown in FIG. 3. When the FLM signal is input to the scan driver 301-1, the selection voltage (Vgon) is applied to the first gate line G1 in synchronism with the input of the CL3 clock. At this time, the non-selection voltage (Vgoff) is applied to the other gate lines from G2 to G768.

The above operation will be described in detail with reference to FIG. 4.

As described above, the FLM signal is set to a "high" level, and the selection voltage (Vgon) is supplied with the voltage waveform Vg1 via the first gate line G1 in synchronism with a fall (trailing edge) timing of the CL3 clock. Further, when the FLM signal is set to a "low level" and the CL3 clock is input again, in synchronism with the fall timing of the CL3 clock, the non-selection voltage (Vgoff) is supplied with the voltage waveform Vg1 via the first gate line G1 while the selection voltage (Vgon) is supplied with the voltage waveform Vg2 via the second gate line G2. Further, when the CL3 clock is input, in synchronism with the fall timing thereof, the non-selection voltage (Vgoff) is supplied with the voltage waveform Vg2 via the second gate line G2 while the selection voltage (Vgon) is supplied with the voltage waveform Vg3 via the third gate line G3.

By repeating the above operation, the selection voltage (Vgon) is successively applied to each gate line until the voltage waveform Vg100 of the 100-th gate line G100. When the selection voltage (Vgon) having the voltage waveform Vg100 is applied to the 100-th gate line G100, the output enable signal (EO1) of the scan driver 301-1 is set to a "high" level, and it is then input to the scan driver 301-2 at the subsequent stage. In the scan driver 301-2, when the output enable signal (EO1) is set to a "high" level and the CL3 clock is input, in synchronism with the fall timing of the CL3 clock, the selection voltage (Vgon) is supplied with the voltage waveform Vg101 of the 101-st gate line G101. Subsequently, the same operation as the scan driver 301-1 is carried out on the scan driver 301-2.

In the scan driver 301-3 and the subsequent scan drivers 301, when the output enable signal is input, the selection voltage (Vgon) is successively applied via the gate bus 211 in synchronism with the fall timing of the CL3 clock in the same manner as described above. By repeating this operation during one frame period, the selection voltage (Vgon) is supplied with all the gate buses 211. Therefore, all the TFTs 216 in the liquid crystal panel 205 are set to the selection status, whereby the gray-scale voltage transmitted from the drain bus 210 can be applied to the liquid crystal 217 of all the pixels.

When one frame period elapses, the FLM signal is set to a "high" level again, and in synchronism with the fall timing (trailing edge timing) of the CL3 clock, the selection voltage (Vgon) is supplied with voltage waveform Vg1 via the first gate line G1 while the non-selection voltage (Vgoff) is supplied with the waveforms via the second gate line G2 and the subsequent gate lines of the gate bus 211. By repeating this operation successively, the display data of each frame period can be displayed on the liquid crystal panel 205.

The problems of the conventional liquid crystal display system as described above will be next described with reference to FIGS. 5 and 6.

FIG. 5 is an operating waveform diagram of the conventional scan driving circuit, and FIG. 6 is a display example of the conventional liquid crystal display.

In FIG. 5, the meaning of each signal is identical to that of FIG. 4. However, in the following description, the generating interval of the FLM pulses is assumed to be shorter than that of the operating waveform of FIG. 4. In FIG. 6, display data are displayed at the upper portion on a screen, black data of a retrace period are displayed at the center portion on the screen, and the display data are also displayed at the lower portion on the screen again.

The timing chart of FIG. 4 is described on the assumption that the total line number in the vertical direction, that is, the number of the CL3 clocks from the "high" level status of FLM until the next "high" level status of FLM is equal to 768 or more. However, some problem would occur if the total line number in the vertical direction, that is, the number of the CL3 clocks from the "high" level status of FLM until the next "high" level status of FLM was equal to 768 or less as shown in FIGS. 5 and 6. In FIG. 5, it is assumed that the total line number in the vertical direction is equal to 765 lines, and thus it is 3 lines short with respect to the total line number of the liquid crystal panel 205.

In FIG. 5, since the FLM signal is set to "high" level when the selection voltage (Vgon) is supplied via the gate line G766, the selection voltage (Vgon) is supplied via the gate line G1 at the same time. If the gate line G1 is set to the selection status, the gray-scale voltage corresponding to the first line data of the display effectiveness data is transmitted through the drain bus 210. Therefore, the same data as display data which are displayed on the gate line G1 are also displayed on the gate line 766 and the subsequent lines, so that the data displayed at the upper portion on the screen are duplicatively displayed at the lower portion on the screen as shown in FIG. 6. Accordingly, there occurs a problem that an excellent display image cannot be obtained.

SUMMARY OF THE INVENTION

An object of the present invention is to provide a liquid crystal driving circuit which can excellently display display data transmitted from a system even when the total line number of the display data is smaller than the total line number of a liquid crystal panel, and a liquid crystal display system using the liquid crystal driving circuit.

In order to attain the above object, a scan driving circuit comprises plural drivers, and each of the scan drivers provides a first line marker signal which is a control signal for making an operation effective, and an output alternating signal which is a control signal for selecting any one of two kinds of voltages of a high voltage level and a low voltage level even for the same data, wherein the scan drivers are divided into a first scan driver group and a second scan driver group, and the first line marker signal is separated by the first scan driver group and the second scan driver group while the output alternating signal is separated by the first scan driver group and the second scan driver group, and wherein means for controlling the generating timing and the status of the two first line marker signals and the two output alternating signals in accordance with the total vertical line number of input display frame data is provided.

When the total vertical line number of the input display frame is smaller than the vertical line number of the liquid crystal panel, the output alternating signal of the first scan driver group is made effective without making effective the first line marker signal of the first scan driver group, and the high voltage level is reflected to all the output signals of the first scan driver group, and at the same time the corresponding TFT of the liquid crystal panel is set to the on status, whereby the write-in operation can be performed.

Further, by invalidating the output alternating signal of the second scan driver group and validating the first line marker signal of the second scan driver group, the high voltage level is successively reflected to the output signals of the second scan driver group to set the corresponding TFT of the liquid crystal panel to the on status, whereby the write-in operation line by line can be successively performed.

Still further, when the total vertical line number of the input display frame data is larger than the vertical line number of the liquid crystal panel, the output alternating signal of the first scan driver group is invalidated and the first line marker signal of the first scan driver group is validated, whereby the high voltage level is successively reflected to the output signal of the first scan driver group to set the corresponding TFT of the liquid crystal panel to the on status, whereby the write-in operation line by line can be successively performed. By validating the first line maker signal of the second scan driver group after the high voltage level is successively reflected to the output signal of the first scan driver group to successively set the corresponding TFT of the liquid crystal panel to the on status, the high voltage level is successively reflected to the output signal of the second scan driver group to set the corresponding TFT of the liquid crystal panel to the on status, whereby the write-in operation line by line can be successively performed.

According to the present invention, since the selection voltage Vgon is simultaneously supplied with all the output terminals of one or more scan drivers, the TFTs of plural lines in the TFT liquid crystal panel can be set to the selection status. Therefore, even when the total vertical line number of the display data is smaller than the total line number of the TFT liquid crystal panel, a defective display due to duplicative display of effective display data can be prevented, and thus an excellent display can be performed.

Further, when the total vertical line number of the input display data is larger than the total line number of the TFT liquid crystal panel, the scan driving circuit successively supplies the selection voltage Vgon with the gate buses from the gate bus G1 in the same manner as the conventional liquid crystal display, so that an excellent display can be performed.

DETAILED DESCRIPTION OF THE PREFERRED EMBODIMENT

A preferred embodiment according to the present invention will be described with reference to FIGS. 1 and 7 to 14.

Figure 1:
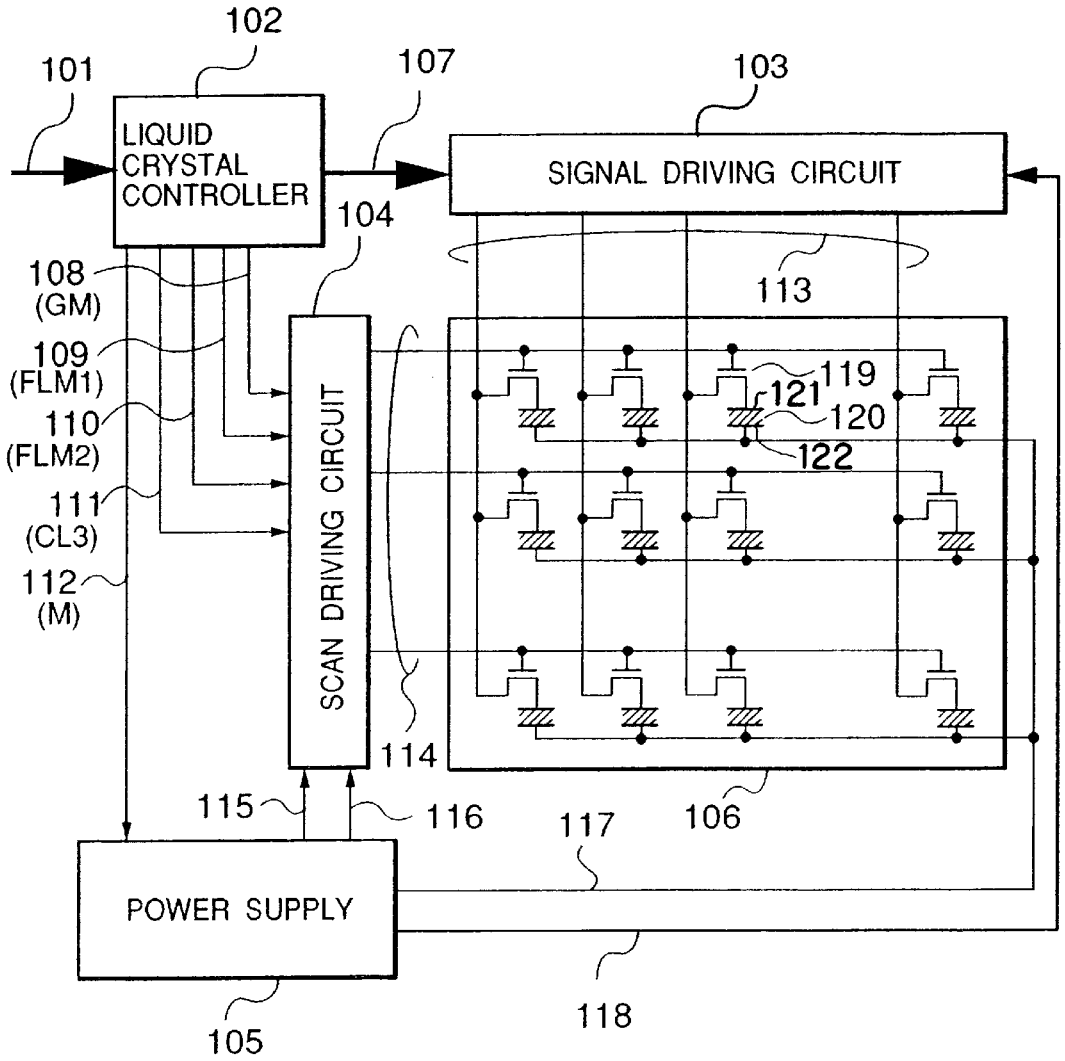
FIG. 1 is a block diagram showing a liquid crystal display according to the present invention.
Figure 2:
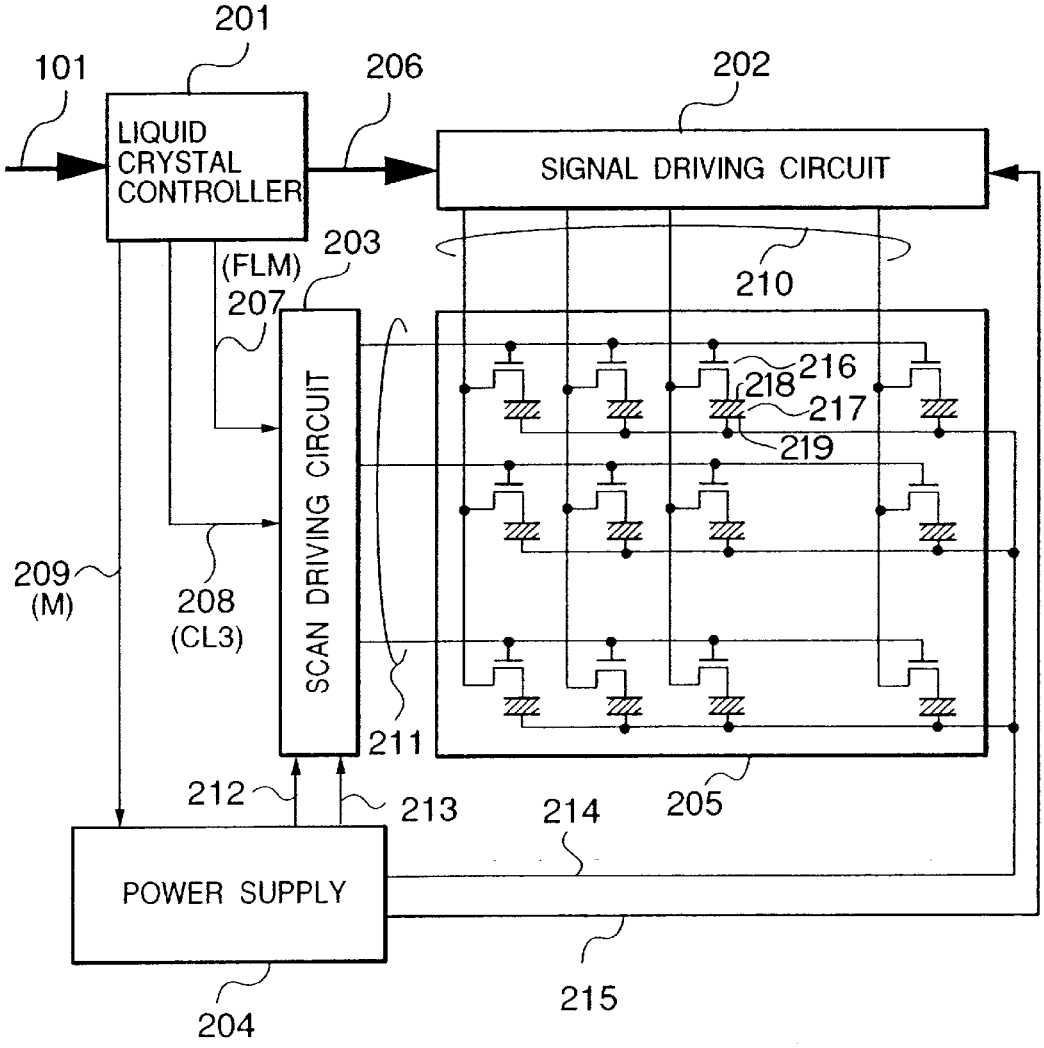
FIG. 2 PRIOR ART
FIG. 2 is a block diagram showing a conventional liquid crystal display.
Figure 3:
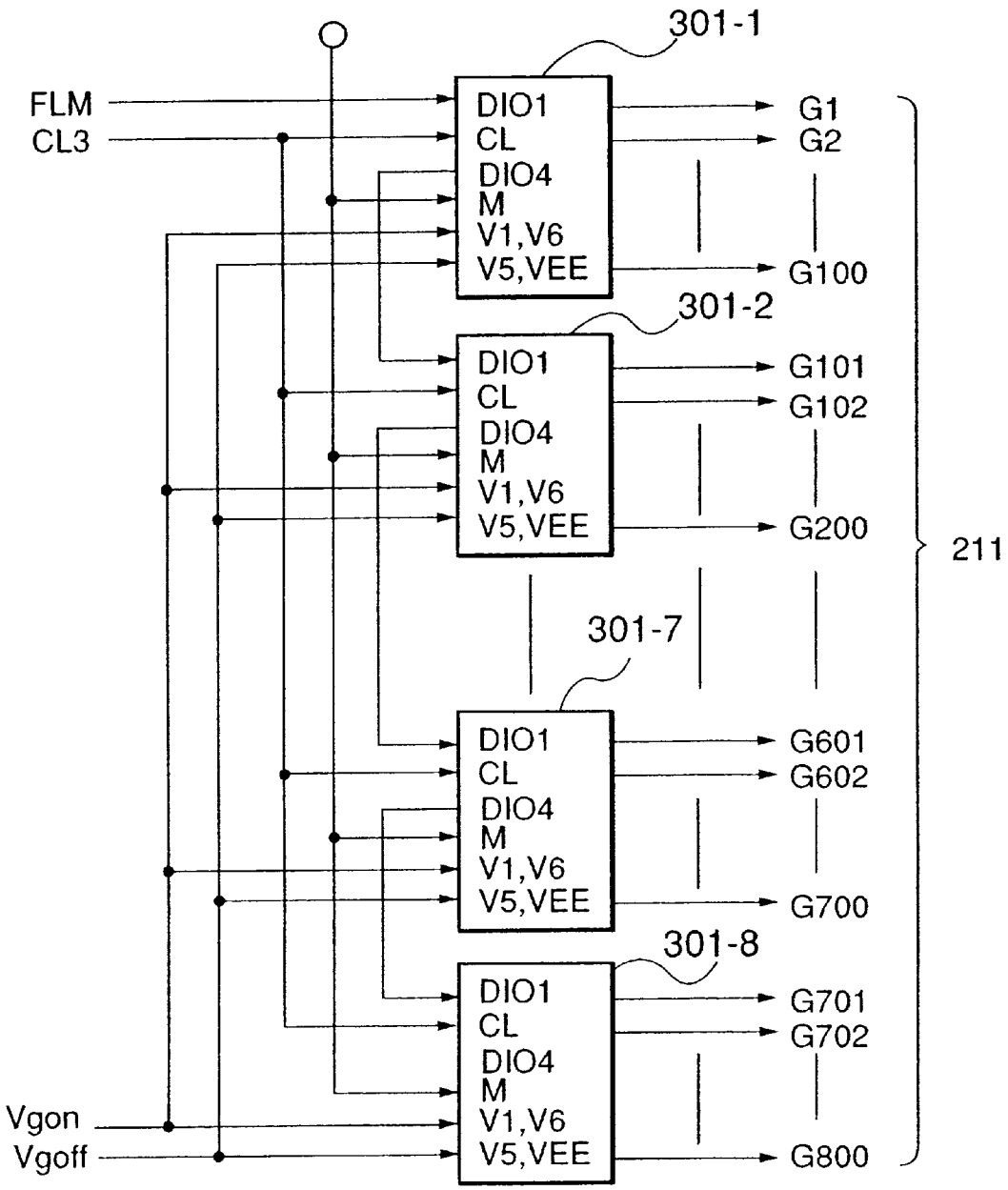
FIG. 3 PRIOR ART
FIG. 3 is a diagram showing a conventional scan driving circuit.
Figure 4:
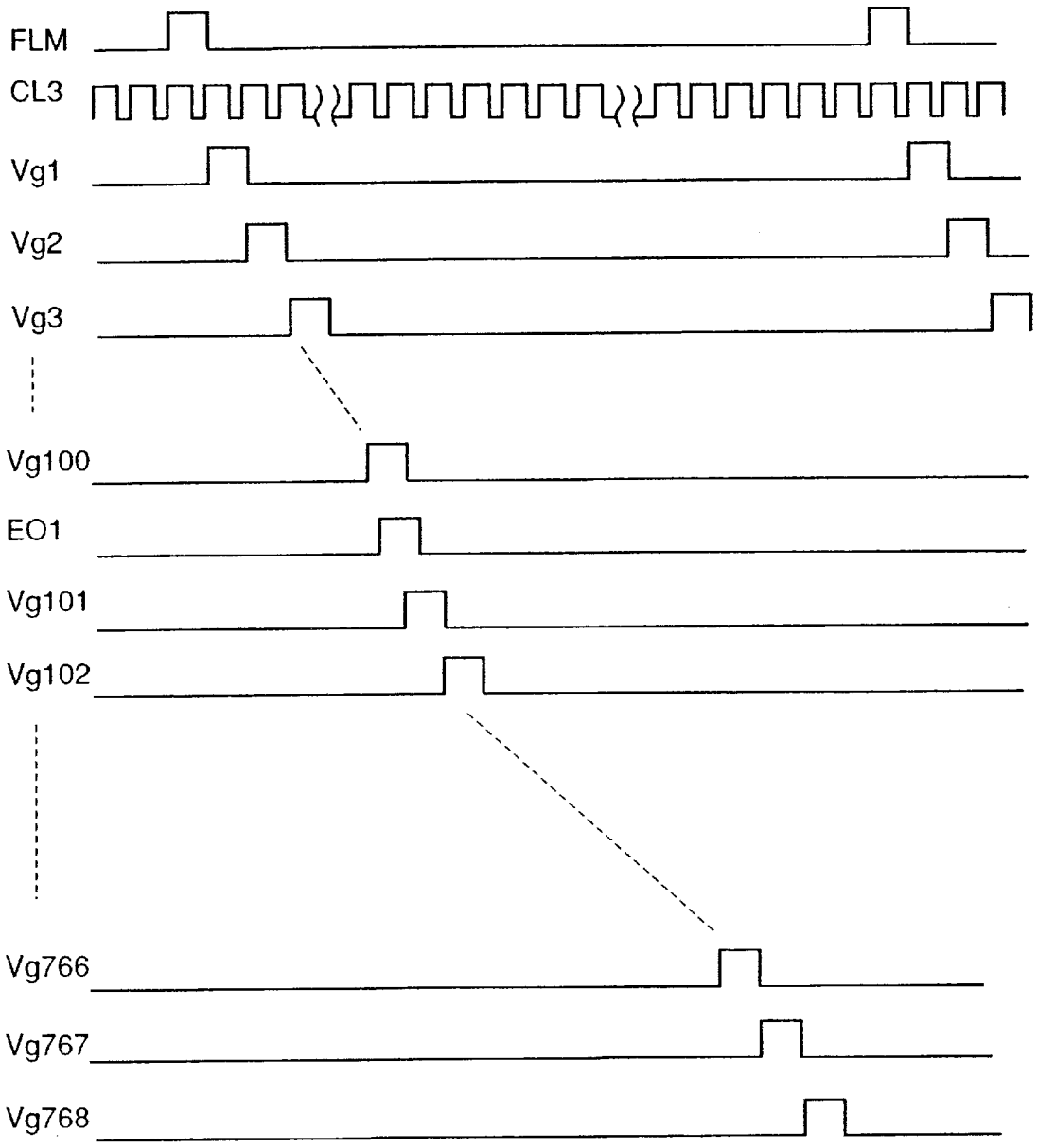
FIG. 4 PRIOR ART
FIG. 4 is an operating waveform diagram of the conventional scan driving circuit.
Figure 5:
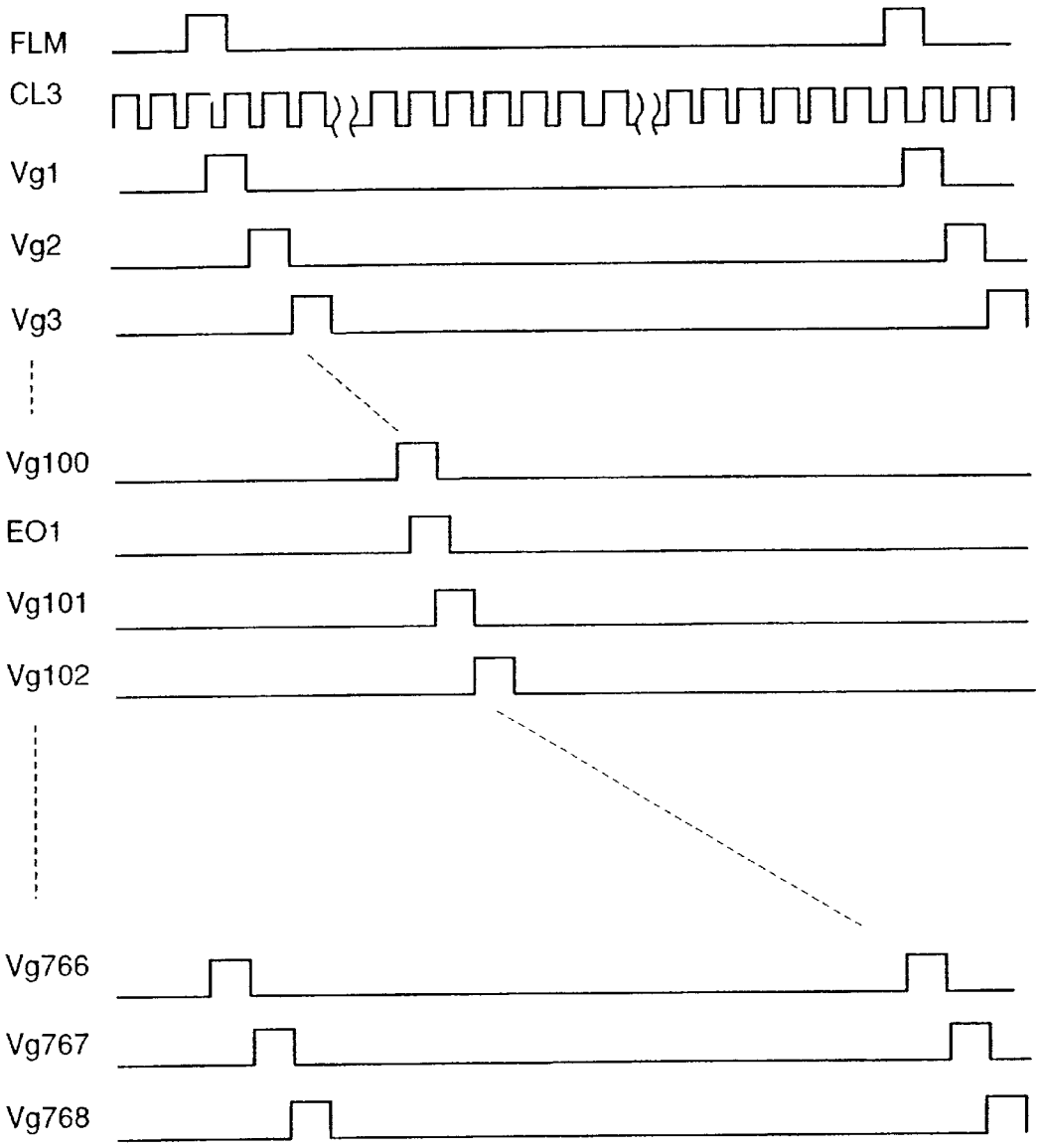
FIG. 5 PRIOR ART
FIG. 5 is an operating waveform diagram showing the conventional scan driving circuit.
Figure 6:
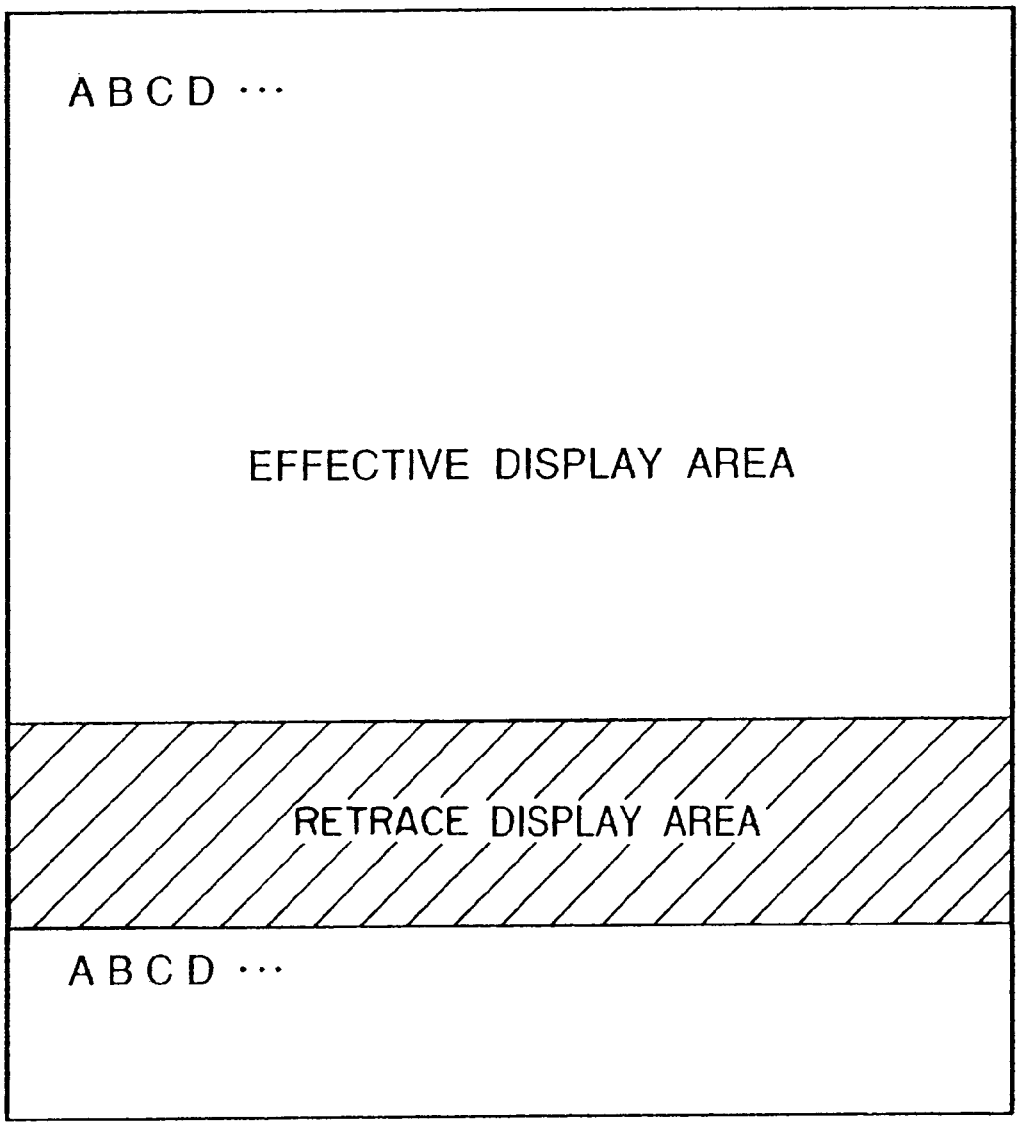
FIG. 6 PRIOR ART
FIG. 6 is a display example of the conventional liquid crystal display.
Figure 7:
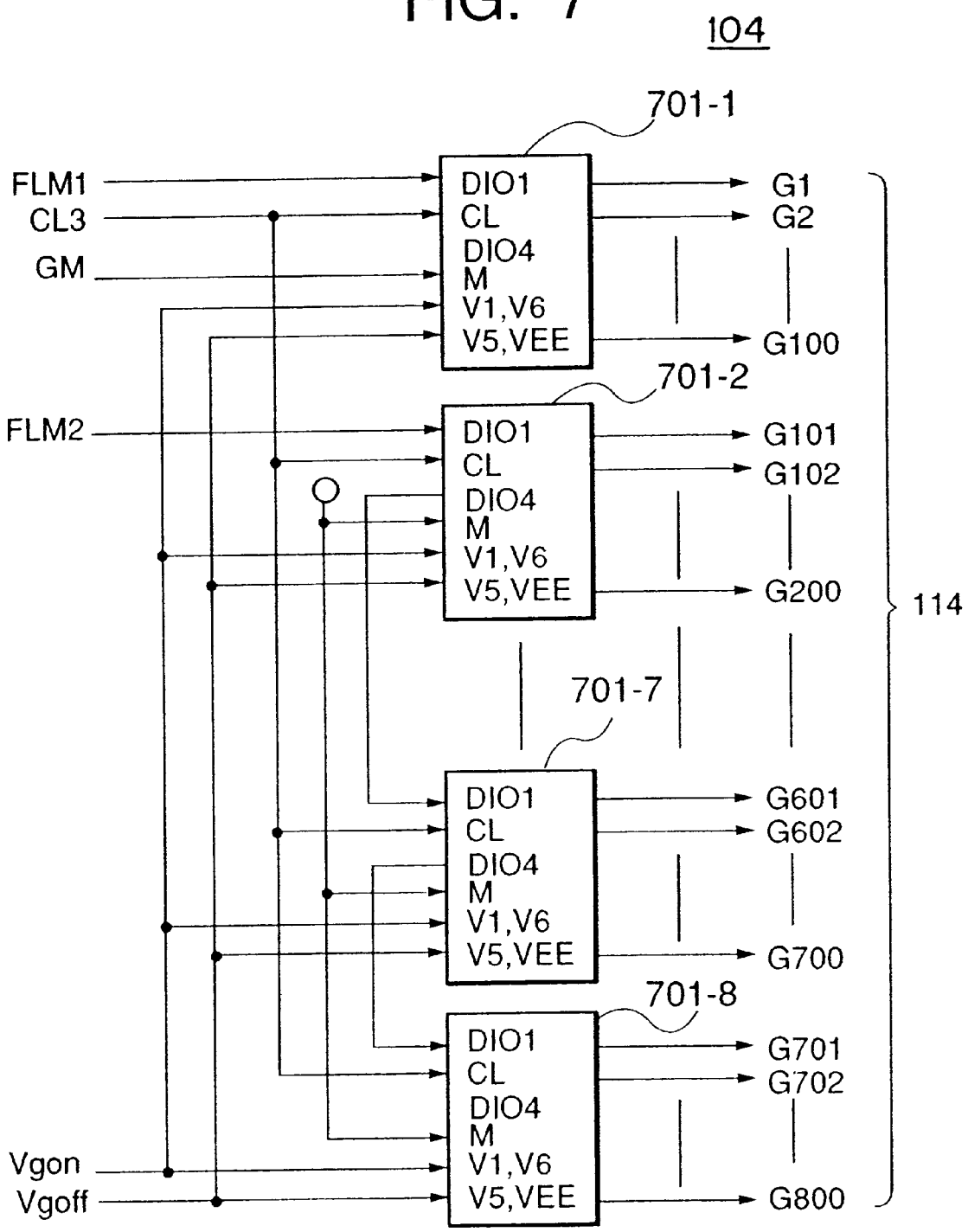
FIG. 7 is a diagram showing a scan driving circuit according to the present invention.
Figure 8:
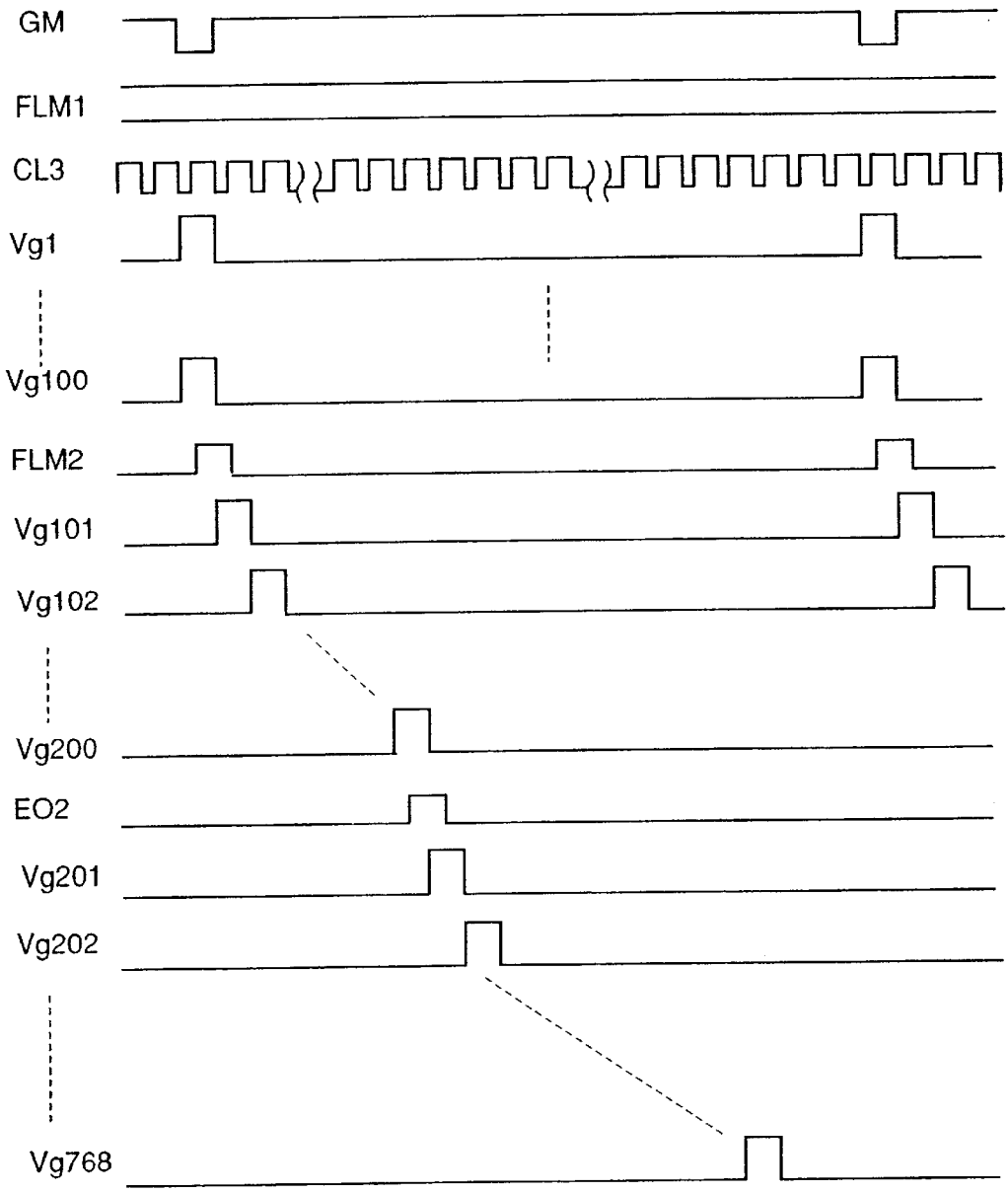
FIG. 8 is an operating waveform diagram showing the scan driving circuit according to the present invention.
Figure 9:
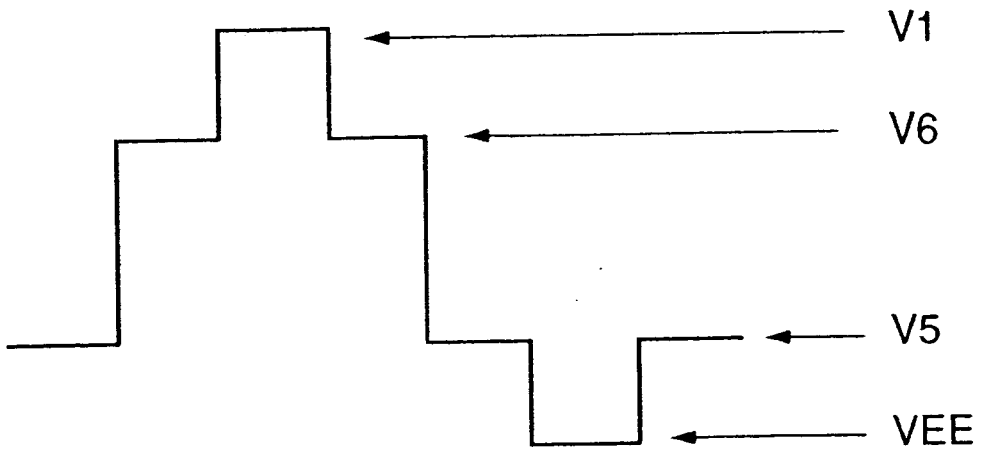
FIG. 9 is a diagram showing variation of the voltage of each scan driver according to the present invention.
Figure 10:
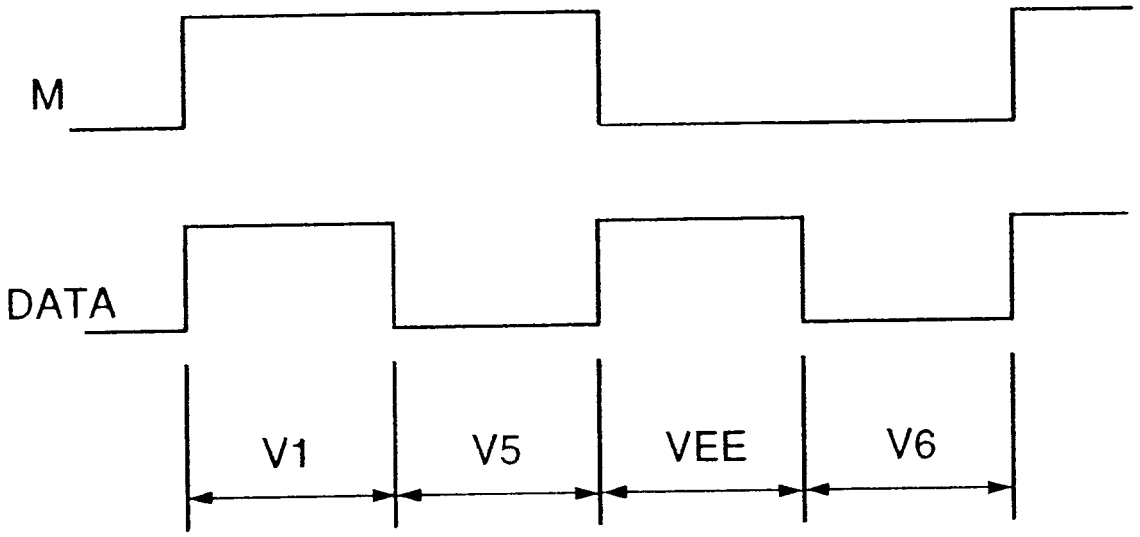
FIG. 10 is a diagram showing the relationship among an alternating signal of the scan driver, data and output voltage level according to the present invention.
Figure 11:
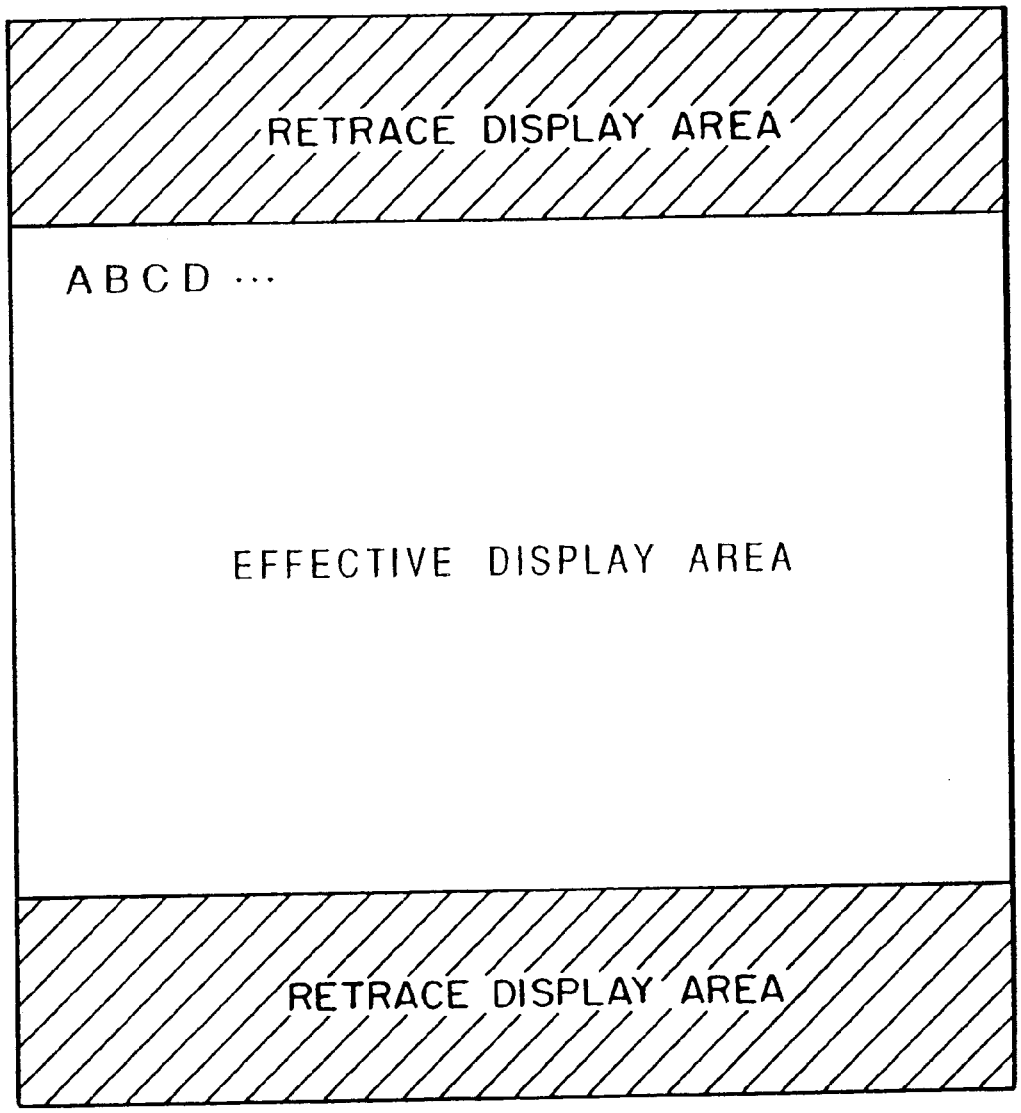
FIG. 11 is a display example of the liquid crystal display according to the present invention.
Figure 12:
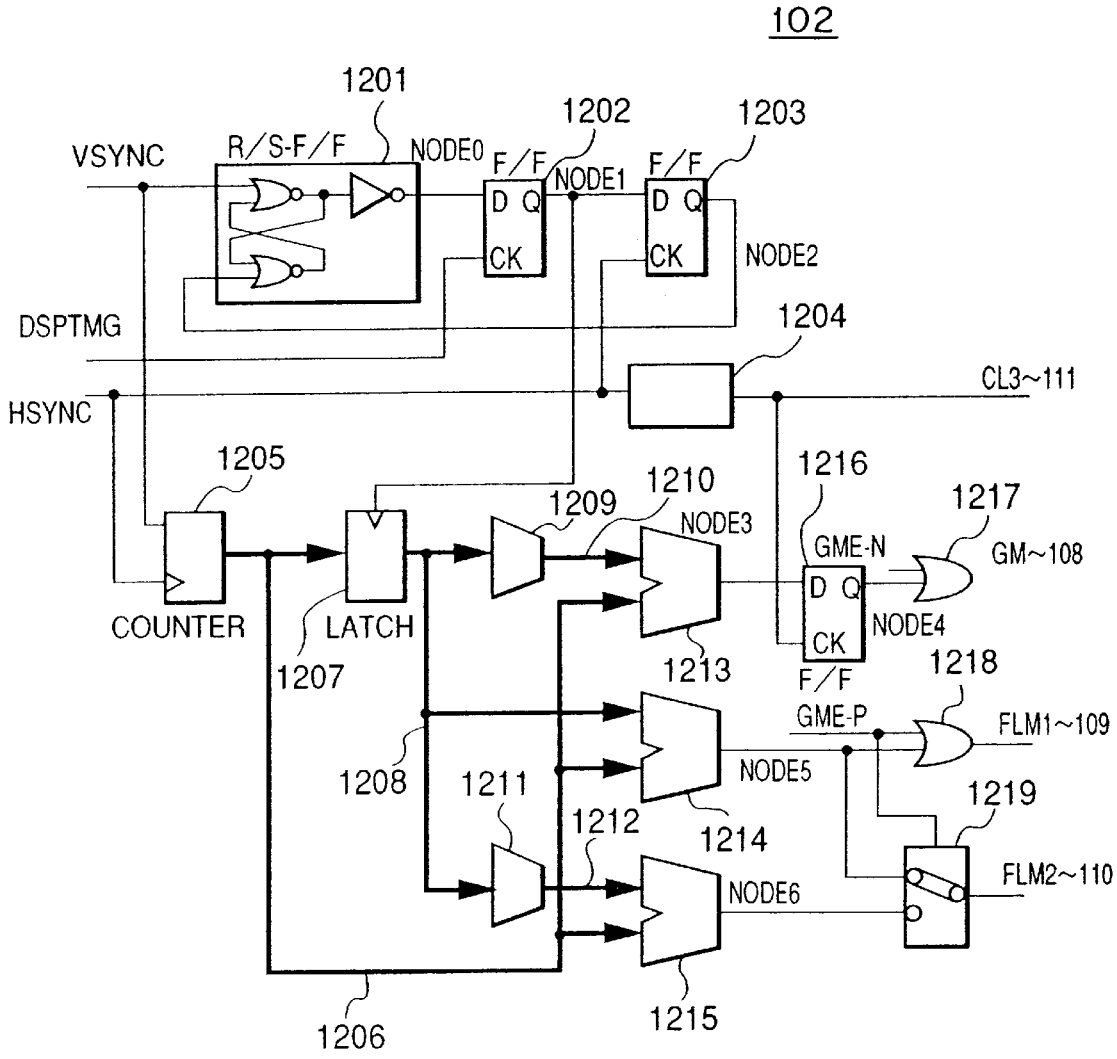
FIG. 12 is a circuit diagram showing a liquid crystal controller according to the present invention.
Figure 13:
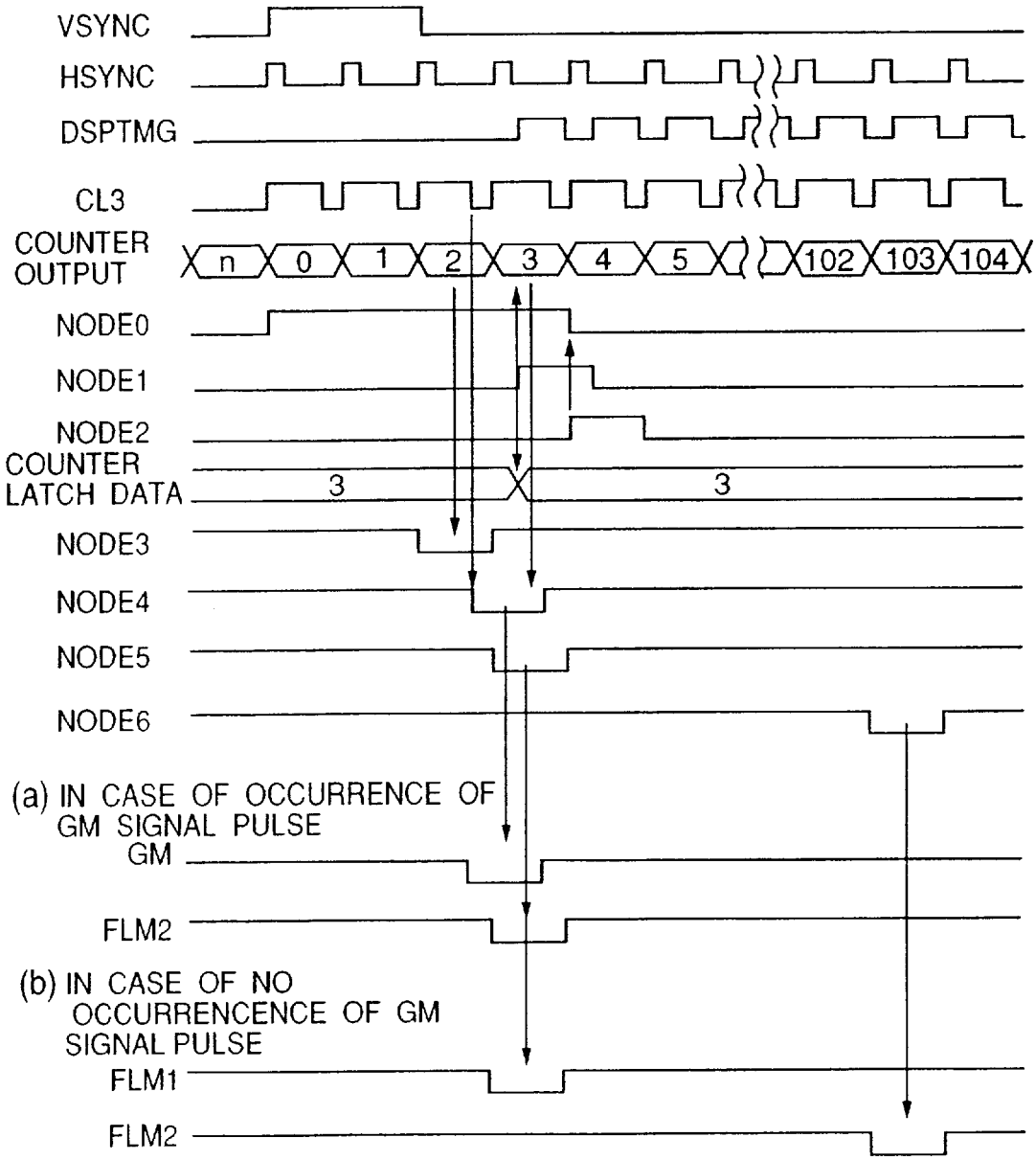
FIG. 13 is a diagram showing the operation of the liquid crystal controller according to the present invention.
Figure 14:
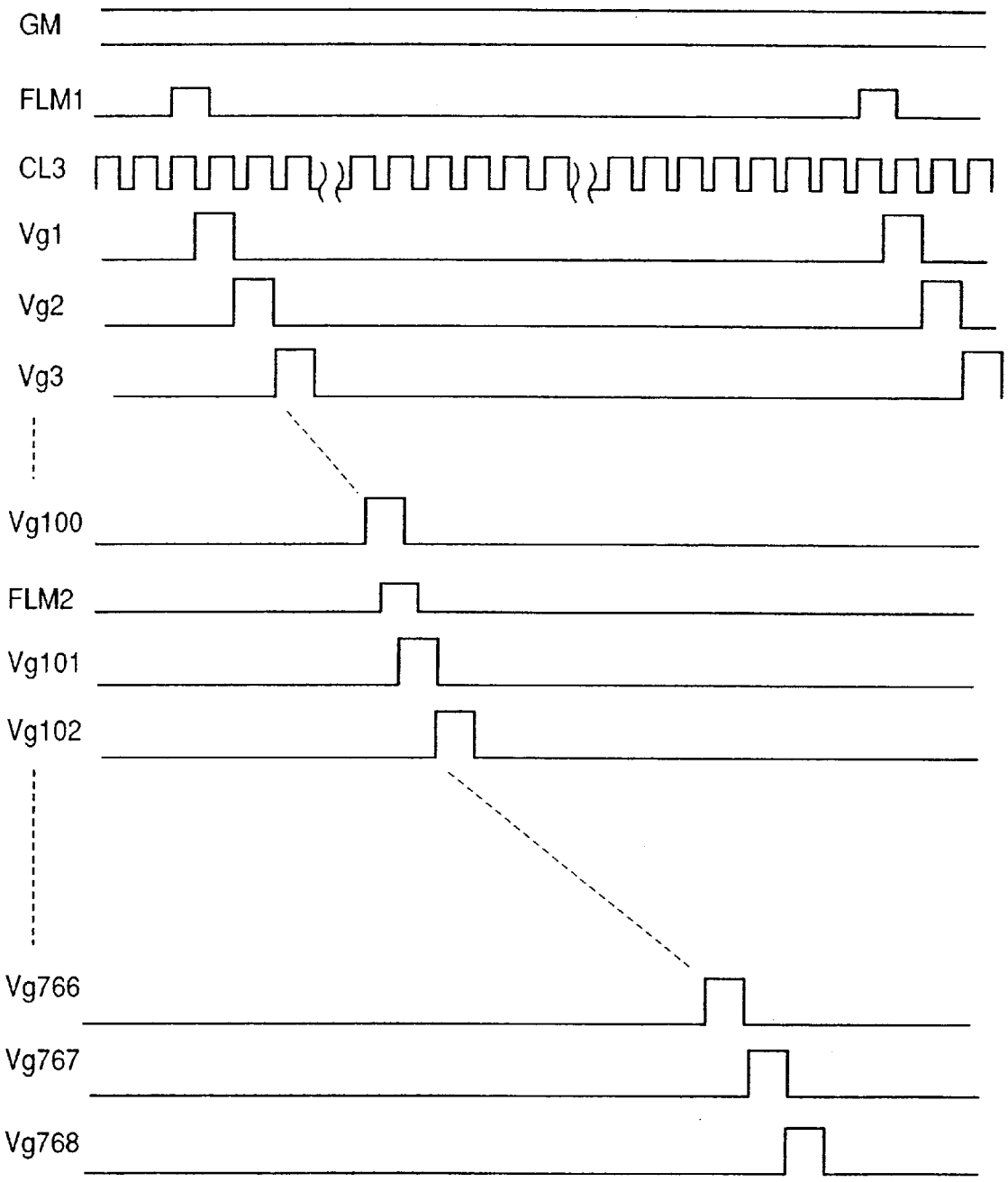
FIG. 14 is another operating waveform diagram of the scan driving circuit according to the present invention.

FIG. 1 is a block diagram showing a liquid crystal display system according to the present invention, FIG. 7 is a diagram showing a scan driving circuit according to the present invention, FIG. 8 is the operating waveform diagram of the scan driving circuit, FIG. 9 is a diagram showing variation of the voltage of a scan driver, FIG. 10 is a diagram showing the relationship among an alternating signal of the scan driver, the data and the output voltage level, FIG. 11 shows a display example of the liquid crystal display, FIG. 12 is a circuit diagram showing a liquid crystal controller according to the present invention, FIG. 13 is a diagram showing the operation of the liquid crystal controller according to the present invention, and FIG. 14 is another operating waveform diagram showing the scan driving circuit.

In FIG. 1, reference numeral 101 represents a signal bus for transmitting display data and a synchronous signal which are supplied from a system (not shown), reference numeral 102 represents a liquid crystal controller, reference numeral 103 represents a signal driving circuit, reference numeral 104 represents a scan driving circuit, reference numeral 105 represents a power supply, and reference numeral 106 represents a TFT liquid crystal panel. Of the output signals from the liquid crystal controller 102, reference numeral 107 represents a signal bus containing the display data and the synchronous signal to be transmitted to the signal driving circuit 103, reference numeral 108 represents an alternating signal GM for inverting the output voltage of the scan driving circuit 104, reference numerals 109 and 110 represent FLM1, FLM2 (first line marker signals) for starting the operation of the scan driving circuit 104, reference numeral 111 represents a CL3 clock serving as an operating clock of the scan driving circuit 104, and reference numeral 112 represents a liquid crystal alternating signal M to be supplied to the power supply 105.

Reference numeral 113 represents a drain bus for transmitting a gray-scale voltage generated by the signal driving circuit 103 to the TFT liquid crystal panel 106. Reference numeral 114 represents a gate bus for setting each line of the TFT liquid crystal panel 106 generated by the scan driving circuit 104 to one of a selection status and a non-selection status. Of the voltages generated by the power supply 105, reference numeral 115 represents a Vgon voltage having a selection voltage level, which is one voltage to be supplied to the scan driving circuit 104, reference numeral 116 represents a Vgoff voltage having a non-selection voltage level, which is another voltage to be supplied to the scan driving circuit 104, reference numeral 117 represents a common electrode line for transmitting a common electrode voltage to be supplied to the liquid crystal panel 106, and reference numeral 118 represents a gray-scale voltage to be supplied to the signal driving circuit 103.

In the TFT liquid crystal panel 106, the drain bus 113 and the gate bus 114 are arranged so as to cross each other in a matrix form, and a crossing portion constituting a pixel comprises a TFT serving as a switching element 119, and a liquid crystal element 120. The gate bus 114 is connected to the gate electrode of the TFT 119, and the drain bus 113 is connected to the drain electrode of the TFT 119. Accordingly, the source electrode 121 of the TFT 119 serves as one electrode of the liquid crystal element 120. A common electrode 122 serves as the other electrode of the liquid crystal element 120, and it is connected to the common electrode line 117.

In FIG. 7, reference numerals 701-1 to 701-8 represent scan drivers, and the scan driving circuit 104 comprises the eight scan drivers 701-1 to 701-8 which can be HD66215 devices (Hitachi LCD controller/driver LSI Data Book: issued by Semiconductor Enterprise Department on March 1994, pp622–634). This embodiment will be described on the assumption that the vertical resolution of the TFT liquid crystal panel 106 is equal to 768 lines. Therefore, G701 to G768 are used for the scan driver 701-8 because the HD66215 has 100 output terminals.

In the scan driver 701-1, FLM1 (109) signal is connected to the input enable signal terminal (DIO1), CL3 (111) is connected to the clock (CL) terminal, alternating signal GM (108) is connected to the alternating terminal (M), the selection voltage level Vgon is connected to power supply terminals V1, V6, and the non-selection voltage level Vgoff is connected to V5, VEE. In the scan driver 701-2, FLM2 (110) is connected to the input enable signal terminal (DIO1).

The input enable signal terminal (DIO1) of the scan driver 701-3 is connected to the output enable signal terminal (DIO4) of the scan driver 701-2 at the front stage. Likewise, with respect to the scan driver 701-4 and the subsequent scan drivers, the input enable signal terminal (DIO1) is cascaded to the output enable signal terminal (DIO4) of the scan driver 701 at the front stage.

With respect to the scan driver 701-2 and the subsequent scan drivers 701, CL3(111) is supplied with the clock (CL) terminal thereof, the selection voltage level Vgon is connected to the power supply terminals V1, V6 thereof, and the non-selection voltage level Vgoff is connected to the power supply terminals V5, VEE. In the scan driver 701-2 and the subsequent scan drivers, all the alternating terminals (M) for realizing alternation of the liquid crystal are fixed to a "high" level.

FIG. 8 is a waveform diagram when the alternating signal 108 (GM) is made effective. In FIG. 8, GM represents the operating waveform of the alternating signal 108, FLM1, FLM2 represent the operating waveform of the first line marker signals 109, 110, CL3 represents the operating waveform of the operating clock 111, EO2 represents a signal of the output enable signal terminal (DIO4) which is output from the scan driver 701-2, and Vg1 to V768 represent the operating waveform of the gate bus 114.

In FIG. 9, V1, V6 represent high voltage levels which are output from the scan drivers 701, and V5, VEE represent low voltage levels which are output from the scan driver 701. Therefore, when the scan driver 701 is used for the TFT liquid crystal display, the Vgon voltage which is set to the selection voltage level is supplied to the terminals V1,V6, and the Vgoff voltage which is set to the non-selection voltage level is supplied to the V5,VEE terminals.

In FIG. 10, when the alternating terminal M is set to "1" and Data is set to "1", the voltage level V1 is selected. Likewise, when the alternating terminal M is set to "1" and the Data is set to "0", the voltage level V5 is selected. When the alternating terminal M is set to "0" and the Data is set to "1", the voltage level VEE is selected. When the alternating terminal M is set to "0" and the Data is set to "0", the voltage level V6 is selected.

FIG. 11 shows a display in which black data of a retrace period are displayed at the upper portion on a screen, display data are displayed at the center portion on the screen and black data of a retrace period are also displayed at the lower portion on the screen.

FIG. 12 is a circuit diagram showing a liquid crystal controller 102 of the present invention. In FIG. 12, reference numeral 1201 represents an RS flip-flop, reference numerals 1202, 1203 represent a flip-flop, and reference numeral 1204 represents a timing adjusting circuit for generating the CL3 clock.

Reference numeral 1205 represents a counter, reference numeral 1206 represents an output bus of the counter 1205, reference numeral 1207 represents a latch for latching data to be transmitted through the counter output bus, reference numeral 1208 represents a data bus for transmitting a count value which is latched by the latch 1207, reference numeral 1209 represents an adder for adding "−1", reference numeral 1210 represents a data bus for transmitting data output from the adder 1209, reference numeral 1211 represents an adder for adding "+100", reference numeral 1212 represents a data bus for transmitting the data output from the adder 1211, each reference numeral 1213, 1214, 1215 represents a comparator, reference numeral 1216 represents a flip-flop, each reference numeral 1217, 1218 represents an OR circuit, and reference numeral 1219 represents a selector.

In FIG. 13, all VSYNC, HSYNC, DSPTMG are synchronous signals contained in the signal bus 101 which is transmitted from the system. VSYNC represents the operating waveform of the vertical synchronous signal, HSYNC represents the operating waveform of the horizontal synchronous signal, and DSPTMG represents a display effectiveness signal indicating that the display data are effective.

The counter output is the value which is output from the counter 1205, and NODE0, NODE1, NODE2, NODE3, NODE4, NODE5, NODE6 represent the operating waveform of signals output from an RS flip-flop 1201, a flip-flop 1202, a flip-flop 1203, a comparator 1213, a flip-flop 1216, a comparator 1214, and a comparator 1215, respectively. (a) of FIG. 13 represents the operating waveform when a pulse occurs in the GM signal, and (b) represents the operating waveform when no pulse occurs in the GM signal.

FIG. 14 is a waveform diagram when the alternating signal 108 (GM) is not made effective, and the meaning of the signal is the same as in FIG. 8.

The detailed operation of the present invention will be described in detail again with reference to FIG. 1.

The liquid crystal controller 102 converts the display data and the synchronous signal transmitted through the signal bus 101 to display data and a liquid crystal driving signal for driving the TFT liquid crystal display. Further, the liquid crystal controller 102 transmits, through the signal bus 107, the display data and the liquid crystal driving signal to be supplied to the signal driving circuit 103, transmits the liquid crystal driving signals to be supplied to the scan driving circuit 104 as GM:108, FLM1:109, FLM2:110, CL3:111, and transmits the signal to be supplied to the power supply 105. In the signal driving circuit 103 as the alternating signal 112, the display data to be transmitted through the signal bus 107 are successively taken in, and when the taking in of the display data of one horizontal line is completed, the display data are converted to a gray-scale voltage corresponding to the display data of one horizontal line and then output from the drain bus 113. This operation is repetitively performed every line by the signal driving circuit 103.

In synchronism with the output of the gray-scale voltage through the drain bus 113 to the liquid crystal panel 106 by the signal driving circuit 103, the scan driving circuit 104 successively supplies the selection voltage to the gate bus 114. The detailed operation of the scan driving circuit 104 will be described later. When the selection voltage (Vgon) is applied via the gate bus 114, the TFT 119 in the TFT liquid crystal panel 106 is set to the selection status and thus the gray-scale voltage is applied through the drain bus 113 to the liquid crystal 120.

In accordance with the effective voltage value applied to the liquid crystal 120, the twisted angle of the liquid crystal is varied, so that the gray-scale display can be performed by controlling the induced ratio of light. Further, when the non-selection voltage (Vgoff) is applied via the gate bus 114, the TFT 119 in the TFT liquid crystal panel 106 is set to the non-selection status to keep the voltage applied to the liquid crystal 120. By repeating this operation during one frame period, the selection of all the TFTs 119 is allowed.

Next, the scan driving circuit 104 will be described with reference to FIGS. 7, 8, 9, 10 and 11.

As shown in FIG. 7, the scan driving circuit 104 comprises the eight scan drivers 701-1 to 701-8. When the GM signal of a "low" level is input to the scan driver 701-1, the selection voltage (Vgon) is supplied to all the gate lines from the first gate line G1 until the 100-th gate line G100. This operation will be described in detail with reference to FIGS. 8 to 10.

The variation of the voltage of the scan driver 701 is shown in FIG. 9. As shown in FIG. 9, V1, V6 has a high voltage level, and it is set to the selection voltage (Vgon). V5, VEE has a low voltage level, and it is set to the non-selection voltage (Vgoff). As shown in FIG. 10, when the alternating terminal M is set to "0" and the Data is set to "0", the voltage level V6 is selected. The Data of all the gate lines G1 to G100 of the scan driver 701 is set to "0", and thus when the alternating signal GM is set to "low" level, the selection voltage level (Vgon) being input to the voltage terminal V6 is output to all the gate lines G1 to G100. Accordingly, the TFTs 119 which are connected to the gate lines G1 to G100 in the TFT liquid crystal panel 106 are set to the selection status, so that the data of 100 lines can be written in during one horizontal period.

In a subsequent step, the alternating signal GM is set to a "high" level. As shown in FIG. 10, when the alternating terminal M is set to "1" and the Data is set to "0", the voltage level V5 is selected. The Data corresponding to all the gate lines G1 to G100 of the scan driver 701 is set to "0", and thus when the alternating signal GM is set to a "high" level, the non-selection voltage level (Vgoff) being input to the voltage terminal V5 is output to all the gate lines G1 to G100, so that the TFTs 119 connected to the gate lines G1 to G100 in the TFT liquid crystal panel 106 are set to the non-selection status.

At this time, the FLM2 signal is set to a "high" level, and the selection voltage (Vgon) appears at the 101-st gate line G101 of the scan driver 701-2 in synchronism with the fall timing of the CL3 clock. Further, when the FLM1 signal is set to a "low" level and the CL3 is input again, in synchronism with the fall timing, the non-selection voltage (Vgoff) is supplied with the voltage waveform Vg101 of the 101-st gate line G101, and the selection voltage (Vgon) is supplied with the voltage waveform Vg102 of the 102-nd gate line G102.

Further, when the CL3 clock is input, the next gate line G103 is set to the selection status. This operation is successively repeated, and the selection voltage (Vgon) is supplied with the voltage waveform Vg200 of the 200-th gate line G200. When the selection voltage (Vgon) is supplied with the voltage waveform Vg2OO of the 200-th gate line G200, the output enable signal (EO2) of the scan driver 701-2 is set to a "high" level, and then input to the scan driver 701-3 at the subsequent stage. In the scan driver 701-3, when the enable signal (EO2) is set to a "high" level and the CL3 clock is input, the selection voltage (Vgon) is supplied with the voltage waveform Vg201 of the 201-st gate line G201 in synchronism with the falling timing.

Subsequently, the same operation as the scan driver 701-1 is performed. In the scan driver 701-3 and the subsequent scan drivers 701-4 to 701-8, when the input enable signal is input, the selection voltage (Vgon) is successively applied via the gate bus 114 in the same manner as described above in synchronism with the falling timing of the CL3. By repeating this operation during one frame period, the selection voltage (Vgon) is applied via all the gate buses 114. Therefore, all the TFTs 119 in the liquid crystal panel 106 are set to the selection status, and the gray-scale voltage transmitted from the drain bus 113 is allowed to be applied to the liquid crystal 120 at all the pixels.

When the one frame period elapses, the alternating signal GM is set to a "low" level again, and the selection voltage (Vgon) is supplied with the voltage waveform Vg1 to Vg100 of the first to 100-th gate lines G1 to G100. In a subsequent step, the FLM2 signal is set to a "high" level, and the selection voltage (Vgon) is supplied to the voltage waveform Vg101 of the 101-st gate line G101 in synchronism with the fall timing of the CL3 clock again. Subsequently, by successively repeating this operation, the display data of each frame period can be displayed on the liquid crystal panel 106.

Accordingly, even when the total vertical line number transmitted from the system is below 768 lines, a display result as shown in FIG. 11 is obtained because the data of 100 lines can be displayed during one horizontal period. In FIG. 11, the upper portion of the screen corresponds to lines which are simultaneously driven by the scan driver 701-1, and the center portion of the screen corresponds to an area for displaying effective display data which are driven by the scan driver 701-1 and the subsequent scan drivers. The lower portion of the screen corresponds to an area for displaying the display data to be transmitted during the retrace period. As described above, according to the present invention, an excellent display can be achieved because display data is not duplicatively displayed at the lower portion of the screen.

With respect to the liquid crystal controller 102 for attaining the driving system of the present invention, a circuit for generating the liquid crystal alternating signal (GM) 108 and the first line marker signals (FLM1, FLM2) 109 and 110 will be described with reference to FIGS. 12 and 13.

In FIG. 12, upon input of the vertical synchronous signal VSYNC, an RS-F/F 1201 sets NODE0 to a "high" level as shown in FIG. 13. Upon input of a display effective signal DSPTMG, F/F 1202 sets its output NODE1 to a "high" level as shown in FIG. 13.

After the vertical synchronous signal VSYNC is input, the counter 1205 counts up in synchronism with the horizontal synchronous signal HSYNC. Accordingly, the latch 1207 latches the data output from the counter 1205 through a data bus 1206 at a rise timing of the NODE1 signal, and transmits the latched data to the data bus 1208. In this embodiment, "3h" is latched (h represents a hexadecimal number).

In the adder 1209, "1h" is subtracted from the data which are latched in the latch 1207, and thus "2h" is output to the data bus 1210. Further, in an adder 1211, the data which are latched by the latch 1207 is added with "64h", and thus "103h" is output to the data bus 1210. Accordingly, NODE3 which is an output generated in a comparator 1213 becomes a pulse as shown in FIG. 13. Likewise, NODE5 which is a signal generated in a comparator 1214 becomes a pulse shown in FIG. 13, and NODE6 which is a signal generated in a comparator 1215 becomes a pulse shown in FIG. 13.

Here, when the total vertical line number is short, that is, when a mode signal GME-N is set to a "low" level, the signal of NODE 4 which is obtained by latching the pulse of NODE3 in the F/F 1216 is output to the GM signal. Likewise, since the mode signal GME-P is set to a "high level", the FLM1 is fixed to a "high" level. Further, the signal of NODE5 is selected and output to FLM2. This situation is shown in (a) of FIG. 13 "Occurrence of GM signal pulse".

On the other hand, when the total vertical line number is sufficient, that is, the mode signal GME-N is set to a "high" level, the GM signal is fixed to a "high" level. Likewise, the mode signal GME-P is set to a "low" level, so that the pulse of NODE5 is output to FLM1. Further, the signal of NODE6 is selected and output to FLM2. This situation is shown in (b) of FIG. 13 "No occurrence of GM signal pulse".

FIG. 14 shows the timing chart when the total vertical line number is sufficient. When the GM signal is fixed to a "high" level and the FLM1 signal is set to a "high" level, the selection voltage (Vgon) appears at the first gate line G1 of the scan driver 701-1 in synchronism with the falling timing of the CL3 clock. Further, when the FLM1 signal is set to a "low" level and the CL3 clock is input again, in synchronism with the falling timing of the CL3 clock, the non-selection voltage (Vgoff) is supplied with the voltage waveform Vg1 of the first gate line G1 while the selection voltage (Vgon) is supplied with the voltage waveform Vg2 of the second gate line G2.

When the CL3 clock is further input, the next gate line G3 is set to the selection status. This operation is repeated, and finally the selection voltage (Vgon) is supplied with the voltage waveform Vg100 of the 100-th gate line G100. When the selection voltage (Vgon) is supplied with the voltage waveform Vg200 of the 200-th gate line G200, the FLM2 signal which is to be input to the scan driver 701-2 is set to a "high" level, and the scan driver 701-2 repeats the same operation.

Accordingly, when the total vertical line number is sufficient, the selection voltage (Vgon) can be successively applied from the gate line G1 without applying the selection voltage (Vgon) to all the output terminals of the first scan driver 701-1, so that an excellent display can be performed.

What is claimed is:

1. A liquid crystal display system comprising:

a liquid crystal panel including pixels which are arranged in a plurality of lines and a plurality of columns in a matrix form;

gray-scale voltage generating means which receives display data for a plurality of lines to convert the display data to a gray-scale voltage and supplies the gray-scale voltage to the pixels; and scan means for setting the pixels to one of a selection status and a non-selection status;

wherein each of the pixels includes a switching element, a pixel electrode, a liquid crystal element, and a liquid crystal common electrode;

wherein an induced ratio of light is controlled based on the gray-scale voltage which is transmitted from the gray-scale voltage generating means and applied to the pixel electrode through the switching element, and an effectiveness voltage of the liquid crystal common voltage which is a voltage of the liquid crystal common electrode, thereby performing a gray-scale display;

wherein the scan means includes a plurality of scan circuits; and wherein the liquid crystal display system further comprises:

means for simultaneously setting all output signals of each of at least one of the scan circuits to a selection status;

means for sequentially setting output signals of each of all remaining ones of the scan circuits to the selection status; and means for changing a number of lines to be selected by at least one of the scan circuits based on a comparison between a total number of the lines of the display data and a total number of the lines of the liquid crystal panel.

2. A liquid crystal display system comprising:

a liquid crystal panel including pixels which are arranged in a plurality of lines and a plurality of columns in a matrix form;

gray-scale voltage generating means which receives display data for a plurality of lines to convert the display data to a gray-scale voltage and supplies the gray-scale voltage to the pixels; and scan means for setting the pixels to one of a selection status and a non-selection status;

wherein each of the pixels includes a switching element, a pixel electrode, a liquid crystal element, and a liquid crystal common electrode;

wherein an induced ratio of light is controlled based on the gray-scale voltage which is transmitted from the gray-scale voltage generating means and applied to the pixel electrode through the switching element, and an effectiveness voltage of the liquid crystal common voltage which is a voltage of the liquid crystal common electrode, thereby performing a gray-scale display;

wherein the scan means includes a plurality of scan circuits;

wherein each of the scan circuits is provided with a first control signal for making an operation effective, and a second control signal for controlling means for selecting one of two kinds of voltages having a high voltage level and a low voltage level even for the same data;

wherein the scan circuits are divided into a first scan circuit group containing at least one scan circuit, and a second scan circuit group containing scan circuits other than the at least one scan circuit of the first scan circuit group; and wherein the liquid crystal display system further comprises:

control means for separating the first control signal according to the first scan circuit group and the second scan circuit group while separating the second control signal according to the first scan circuit group and the second scan circuit group; and means for changing a number of lines to be selected by at least one scan circuit of the first scan circuit group based on a comparison between a total number of the lines of the display data and a total number of the lines of the liquid crystal panel.

3. A liquid crystal display system according to claim 2, further comprising:

means for making the second control signal of the first scan circuit group effective to reflect a high voltage level to all the output signals thereof; and means for setting the second control signal of the second scan circuit group so that the high voltage level is successively reflected to the output terminals thereof, and making the first control signal effective to successively reflect the high voltage level to the output terminals thereof.

4. A liquid crystal display system according to claim 2, further comprising means for setting the second control signals of the first scan circuit group and the second scan circuit group so that a high voltage level is successively reflected to the output terminals thereof, making the first control signal of the first scan circuit group effective to successively reflect the high voltage level to the output terminals thereof, and then making the first control signal of the second scan circuit group effective to successively reflect the high voltage level to the output terminals thereof after the high voltage level has been successively reflected to all the output signals of the first scan circuit group.

5. A liquid crystal display system comprising:

a liquid crystal panel including pixels which are arranged in a plurality of lines and a plurality of columns in a matrix form;

a gray-scale voltage generator which receives display data for a plurality of lines to convert the display data to a gray-scale voltage and supplies the gray-scale voltage to the pixels; and a scan driver which sets the pixels to one of a selection status and a non-selection status;

wherein each of the pixels includes a switching element, a pixel electrode, a liquid crystal element, and a liquid crystal common electrode;

wherein an induced ratio of light is controlled based on the gray-scale voltage which is transmitted from the gray-scale voltage generator and applied to the pixel electrode through the switching element, and an effectiveness voltage of the liquid crystal common voltage which is a voltage of the liquid crystal common electrode, thereby performing a gray-scale display;

wherein the scan driver includes a plurality of scan circuits; and wherein the liquid crystal display system further comprises a liquid crystal controller which simultaneously sets all output signals of each of at least one of the scan circuits to a selection status, sequentially sets output signals of each of all remaining ones of the scan circuits to the selection status, and changes a number of lines to be selected by at least one of the scan circuits based on a comparison between a total number of the lines of the display data and a total number of the lines of the liquid crystal panel.

* * * * *